US009784255B2

(12) United States Patent
Hogan

(10) Patent No.: US 9,784,255 B2
(45) Date of Patent: Oct. 10, 2017

(54) TRI-CHAMBER NUTATING PUMP

(71) Applicant: Fluid Management Operations LLC, Wheeling, IL (US)

(72) Inventor: Tim Patrick Hogan, Bristol, WI (US)

(73) Assignee: FLUID MANAGEMENT OPERATIONS LLC, Wheeling, IL (US)

( * ) Notice: Subject to any disclaimer, the term of this patent is extended or adjusted under 35 U.S.C. 154(b) by 82 days.

(21) Appl. No.: 14/905,920

(22) PCT Filed: Jul. 21, 2014

(86) PCT No.: PCT/US2014/047369
§ 371 (c)(1),
(2) Date: Jan. 18, 2016

(87) PCT Pub. No.: WO2015/010117
PCT Pub. Date: Jan. 22, 2015

(65) Prior Publication Data

US 2016/0153433 A1 Jun. 2, 2016

Related U.S. Application Data

(60) Provisional application No. 61/856,274, filed on Jul. 19, 2013.

(51) Int. Cl.
*F04B 11/00* (2006.01)
*F04B 7/06* (2006.01)

(52) U.S. Cl.
CPC ..... *F04B 7/06* (2013.01); *F04B 11/0075* (2013.01)

(58) Field of Classification Search
CPC ..... F04B 11/0075; F02B 7/06
(Continued)

(56) References Cited

U.S. PATENT DOCUMENTS 3,447,468 A 6/1969 Kinne
4,008,003 A 2/1977 Pinkerton
(Continued)

FOREIGN PATENT DOCUMENTS

EP 1826404 A2 8/2007
EP 1826404 B2 8/2007
(Continued)

OTHER PUBLICATIONS

International Search Report for related International Application No. PCT/US14/47369; report dated Oct. 21, 2014.

*Primary Examiner* — Mark Laurenzi
*Assistant Examiner* — Dapinder Singh
(74) *Attorney, Agent, or Firm* — Miller, Matthias & Hull LLP

(57) ABSTRACT

A tri-chamber nutating pump is disclosed which includes two pump chambers disposed within a pump housing that accommodates a nutating piston. A reciprocating compensating piston is also provided with its own compensating housing that is connected to the outlet. As a cumulative output from the first two pump chambers reaches its maximum level, the compensating piston is pushed into the outlet or through a passage to reduce the output of the first two chambers and avoid splashing. As the output from the first two chambers reaches its minimum level, the compensating piston is withdrawn from the outlet or through a passage thereby increasing the output of the third chamber to its maximum level when the output from the first two pump chambers reaches its minimum level.

10 Claims, 9 Drawing Sheets

(58) Field of Classification Search
USPC ..... 418/104
See application file for complete search history.

(56) References Cited

U.S. PATENT DOCUMENTS

| | | | | |
|---|---|---|---|---|
| 4,610,609 | A * | 9/1986 | Milburn, Jr. | F04B 1/1133 417/466 |
| 5,482,448 | A | 1/1996 | Atwater et al. | |
| 6,398,513 | B1 | 6/2002 | Amsler et al. | |
| 6,540,486 | B2 | 4/2003 | Barton et al. | |
| 6,732,647 | B2 | 5/2004 | Uera et al. | |
| 7,648,349 | B2 * | 1/2010 | Hogan | F04B 11/0075 417/486 |
| 7,946,832 | B2 * | 5/2011 | Hogan | B01F 5/12 417/486 |
| 8,353,690 | B2 | 1/2013 | Hogan et al. | |
| 2004/0013531 | A1 | 1/2004 | Curry et al. | |
| 2007/0196223 | A1 * | 8/2007 | Hogan | F04B 11/0075 417/500 |

FOREIGN PATENT DOCUMENTS

| | | | |
|---|---|---|---|
| WO | 02/05225 | A1 | 3/2002 |
| WO | 0225225 | A1 | 3/2002 |

* cited by examiner

Normalized Flow, .500" Diameter Piston. Standard Pump
800 RPM Fixed Flowrate
Normalized Flowrate
900
800
700
600
500
400
300
200
100
0
-100
-200
-300
-400
-500
-600
-700
-800
-900
-1000
0.000000
0.020000
0.040000
0.060000
0.080000
0.100000
Time (seconds)
DISPENSE
FILL
1
2

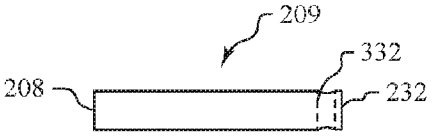
FIG.10
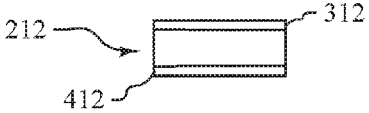
FIG.11
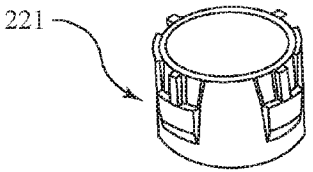
FIG.12
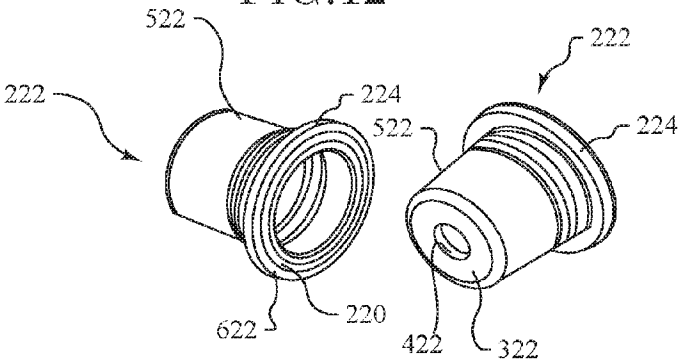
FIG.13
FIG.14
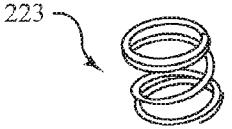
FIG.15
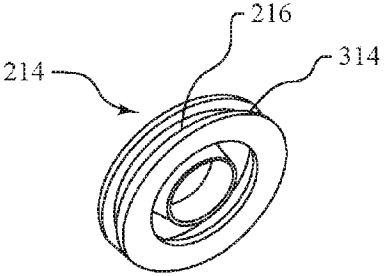
FIG.16
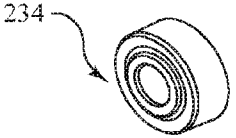
FIG.17
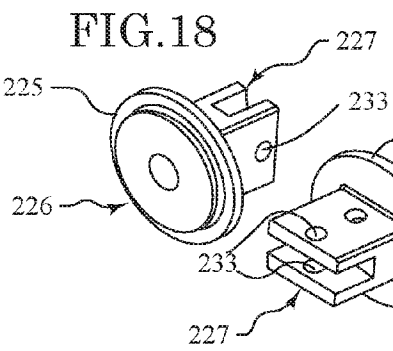
FIG.18
FIG.19
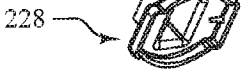
FIG.20
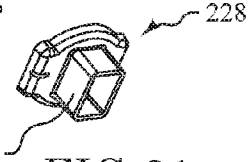
FIG.21
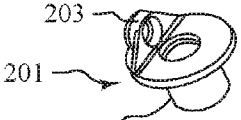
FIG.22
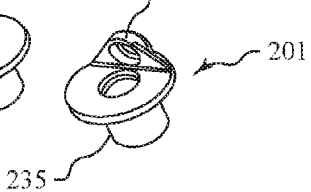
FIG.23

TRI-CHAMBER NUTATING PUMP

CROSS-REFERENCE TO RELATED APPLICATIONS

This application is a 35 U.S.C §371 U.S. national stage filing of International Patent Application No. PCT/US14/47369 filed on Jul. 21, 2014, which claims priority under the Paris Convention and 35 U.S.C §120 to U.S. Provisional Patent Application No. 61/856,274, filed on Jul. 19, 2013.

FIELD OF THE DISCLOSURE

Improved nutating pumps are disclosed with a third chamber added to the dual-chamber pump of U.S. Pat. No. 7,946,832, which is incorporated herewith. The third chamber is disposed adjacent to a compensating piston, or other actively driven displacement device, which provides a cyclic displacement (zero net flow through the cycle), which compensates for pulsations in output flow the dual-chamber pump of U.S. Pat. No. 7,946,832. The disclosed pumps also provide a more steady flow than the four chamber pump disclosed in U.S. Pat. No. 8,353,690, which is also incorporated herewith. The disclosed tri-chamber pumps provide an output flow, which for all practical purposes, is a steady flow resulting in the essentially the same flow output for each motor step.

BACKGROUND OF THE DISCLOSURE

Nutating pumps are pumps having a piston that both rotates about its axis and contemporaneously slides axially and reciprocally within a liner or casing. With a full pump chamber, as the piston is rotated 360° about its axis, the piston slides axially through a dispense stroke and returns to its initial position after an intake or "fill" stroke. The combined 360° rotation and reciprocating axial movement of the piston produces a sinusoidal dispense profile illustrated in FIG. 1. The line 1 graphically illustrates the flow rate at varying points during one revolution of the piston. The portion of the curve 1 above the horizontal line 2 representing a zero flow rate represents the dispense or output stroke while the portion of the curve 1 disposed below the line 2 represents the intake or fill stroke.

Further, because the output is not linear (see the line 1 of FIG. 1), some users limit the operation of conventional nutating pumps to complete 360° revolutions of the piston or at least one full dispense stroke. However, this methodology often requires a user to choose between a small pump that requires multiple revolutions of the piston to dispense the required volume and a large pump that requires a partial revolution of the piston to dispense the required volume. Further, the operator may also have to choose between running the motor of a small pump at high speeds to dispense larger volumes and running the motor of a large pump at slow or minimum speeds for smaller volumes.

To avoid this dilemma, stepper motors have been used with nutating pumps to provide a partial revolution dispense. While using a partial revolution to accurately dispense fluid from a nutating pump is difficult due to the non-linear output of the nutating pump dispense profile (i.e., see FIG. 1), controllers, software algorithms and sensors can be used to monitor the angular position of the piston. Using this angular position, the controller can calculate the number of steps required to achieve the desired output as disclosed in U.S. Pat. No. 6,749,402, which is incorporated herewith. The sinusoidal profile illustrated in FIG. 1 is based upon a nutating pump operating at a constant motor speed. While operating the nutating pump at a constant motor speed has its benefits in terms of simplicity of controller design and pump operation, the use of a constant motor speed has inherent disadvantages.

Specifically, in certain applications, the maximum output flow rate illustrated on the left side of FIG. 1 can be disadvantageous because the output fluid may splash or splatter as the fluid is pumped into the output receptacle at the higher flow rates. For example, in paint or cosmetics dispensing applications, any splashing of the colorant as it is being pumped into the output container results in an inaccurate dispense as well as colorant being splashed on the machine, which requires labor-intensive clean up and maintenance. This splashing problem will adversely affect any nutating pump application where precise amounts of output fluid are being delivered to small receptacles or to output receptacles that are either full or partially full of liquid.

For example, the operation of a conventional nutating pump having the profile of FIG. 1 results in pulsed output flow as shown in FIGS. 2 and 3. The pulsed flow shown at the left in FIGS. 2 and 3, at speeds of 800 and 600 rpm respectively, results in pulsations 3 and 4, which are a cause of unwanted splashing. FIGS. 2 and 3 are renderings of actual digital photographs of an actual nutating pump in operation. While reducing the motor speed from 800 to 600 rpm results in a smaller pulse 4, the reduction in pulse size is minimal and the benefits are offset by the slower operation. To avoid splashing altogether, the motor speed would have to be reduced more than 20% thereby making the choice of a nutating pump less attractive despite its high accuracy.

A further disadvantage to the sinusoidal profile of FIG. 1 is an accompanying pressure spike that causes an increase in motor torque. Specifically, the large pressure drop that occurs within a nutating pump as the piston rotates from the point where the dispense rate is at a maximum to the point where the intake rate is at a maximum (i.e. the peak of the curve shown at the left in FIG. 1 to the valley of the curve shown towards the right in FIG. 1) can result in motor stalling for those systems where the motor is operated at a constant speed. Motor stalling will result in an inconsistent or non-constant motor speed, thereby affecting the sinusoidal dispense rate profile illustrated in FIG. 1 and any control system or control method based upon a preprogrammed sinusoidal dispense profile. The stalling problem will occur on the intake side of FIG. 1 as well as when the pump goes from the maximum intake flow rate to the maximum dispense flow rate.

The splashing and stalling problems are addressed in U.S. Pat. No. 6,749,402, specifically in FIG. 4, which shows a modified dispense profile 1*a* where the motor speed is varied during the pump cycle to flatten the curve 1 of FIG. 1. The variance in motor speed results in a reduction of the peak output flow rate while maintaining a suitable average flow rate by (i) increasing the flow rates at the beginning and the end of the dispense portion of the cycle, (ii) reducing the peak dispense flow rate, (iii) increasing the duration of the dispense portion of the cycle and (iv) reducing the duration of the intake or fill portion of the cycle. This is accomplished using a computer algorithm that controls the speed of the motor during the cycle thereby increasing or decreasing the motor speed as necessary to achieve a dispense curve like that shown in FIG. 4.

However, the nutating pump design of U.S. Pat. No. 6,749,402 as shown in FIG. 4, while reducing splashing, still results in a start/stop dispense profile and therefore the dispense is not a pulsation-free or a steady, smooth flow. Despite the decrease in peak dispense rate, the abrupt increase in dispense rate shown at the left of FIG. 4 and the abrupt drop off in flow rate shown near the center of FIG. 4 still provides for the possibility of some splashing. Further, the abrupt starting and stopping of the dispensing followed by a significant lag time during the fill portion of the cycle still presents the problems of significant pressure spikes and gaps in the fluid stream exiting the dispense nozzle. Any decrease in the slope of the portions of the curves shown at 1*a*, 1*c* would require an increase in the cycle time as would any decrease in the maximum fill rate. Thus, the only modifications that can be made to the cycle shown in FIG. 4 to reduce the abruptness of the start and finish of the dispensing portion of the cycle would result in increasing the cycle time and/or reducing the maximum fill rate.

Turning to FIG. 5, the dual-chamber nutating pump 20 of U.S. Pat. No. 7,946,832 is shown. The dual chamber pump 20 includes a rotating and reciprocating piston 10 that is disposed within a pump housing 21. The pump housing 21 is coupled to an enclosure 22 as well as to an intermediate housing 23 used primarily to house the coupling 24 that connects the piston 10 to the drive shaft 25, which in turn, is coupled to the motor 26. The coupling 24 is connected to the proximal end 30 of the piston 10 by a link 27 (see FIG. 6). A proximal section 28 of the piston 10 has a first maximum outer diameter that is substantially less than a second maximum outer diameter of the larger pump section 29 of the piston 10. The purpose of the larger maximum outer diameter of the pump section 29 of the piston 10 is the creation of a second pump chamber 44 in addition to the first pump chamber 42. The proximal section 28 connects to the pump section 29 at a beveled transition section 31. The pump section 29 of the piston 10 passes through a middle seal 32. The distal end 33 of the pump section 29 of the piston 10 is received in a distal seal 34. The fluid inlet is shown at 35 and the fluid outlet is shown at 36. The proximal section 28 of the piston 10 passes through a proximal seal 38 disposed within the seal housing 39.

The first pump chamber 42 is an area where fluid is primarily displaced by the axial movement of the piston 10 towards the end cap 22 as well as the rotation of the piston 10 and the engagement of fluid disposed in the first chamber 42 by the machined flat area 13. A conduit or passage 43 connects the first chamber 42 to the second chamber 44. The beveled transition section 31 between the outer diameters of the proximal section 28 and the larger pump section 29 of the piston 10 generates displacement through the second chamber 44.

The piston 10 is shown at the middle of its stroke in FIG. 5 as the end 33 of the pump section 29 of the piston 10 approaches the head 22. Fluid is forced out of the first chamber 42 and into the passage 43 (see the arrow 46). This action displaces fluid disposed in the passage 43 and causes it to flow around the proximal section 28 and transition section 31 of the piston 10, or through the second chamber 44 as shown in FIG. 5. It will also be noted that the flat or machined area 13 of the piston 10 has been rotated thereby also causing fluid flow in the direction of the arrow 46 through the passage 43 and towards the second chamber 44. FIG. 6 illustrates a reciprocating movement back towards the top of the intake stroke. The piston 10 moves in the direction of the arrow 47, which causes the transition section 31 to enter the second chamber 44 thereby causing fluid to be displaced through the outlet 36 or in the direction of the arrow 48. No fluid is being pumped from the first chamber 42 in FIG. 6 but, instead, the first chamber 42 is being loaded with fluid entering through the inlet 35 and flowing into the chamber 42 in the direction of the arrow 49.

Instead of all of the fluid in the first chamber 42 being dispensed during the first 180° of rotation of the piston 10 as with conventional nutating pumps (see FIG. 1), a portion of the fluid pumped from the first chamber 42 is pumped from the second chamber 44 during second 180° of rotation of the piston 10, or during the fill portion of the of the cycle illustrated in FIG. 6. In other words, a portion of the fluid being pumped is temporarily stored in the second chamber 44 and the stored fluid is then dispensed during the fill portion of the cycle as opposed to all of the fluid being dispensed during the dispense portion of the cycle as illustrated in FIG. 1. As a result, the output flow during the first 180° of rotation of the piston 10 is reduced and some of that flow is pumped out of the second chamber 44 during the subsequent second 180° of rotation of the piston 10 during the fill portion of the cycle.

Turning to FIG. 7, a dispense profile is shown for a dual-chamber pump 20 constructed in accordance with FIGS. 5-6 and operating at a constant motor speed of 800 rpm. Two dispense portions are shown at 1*d* and 1*e* and a fill portion of the profile is shown at 1*f*. A break in dispensing occurs at the beginning of the fill portion of the cycle and moderated dispense flows are shown by the curves 1*d*, 1*e*.

However, the dual-chamber pump 20 of FIGS. 5-7, despite the improvements, can create pulsations, which can lead to splashing and inaccurate dispenses. Further, as shown by the non-linear dispense profile of FIG. 7, the pump 20 would need to be equipped with a sophisticated control system and feedback control components in order to accurately dispense a volume of fluid less than the volume dispensed during a full cycle. Accordingly, there is a need for an improved nutating pump, also adapted for mixing and having multiple pump chambers, with improved control and/or a method of control thereof whereby the pump motor is controlled so as to reduce the likelihood of splashing and pulsing during a dispense without compromising pump speed and accuracy.

SUMMARY OF THE DISCLOSURE

In one aspect, a tri-chamber pump is disclosed. As opposed to dual-chamber nutating pumps as disclosed in U.S. Pat. No. 7,946,832, the disclosed tri-chamber includes an additional third chamber through which the output flow of the first two chambers passes. The third chamber includes a separate piston, referred to herein as the compensating piston, and a seal. The third chamber, compensating piston and seal act to provide a cyclic displacement, which is used to compensate for cyclic pulsations in the output flow of the first two chambers. The net displacement of the third chamber is zero. The third chamber is used to increase and decrease flow through the first two chambers during a pump cycle or one full rotation of the primary piston.

For example, the third chamber and compensating piston may retard the output flow during peaks in the output flow from the first two chambers during a pump cycle. Then, the third chamber and compensating piston increase the output flow as the output from the first two chambers approaches low points or valleys during a pump cycle. As a result, the cyclic output flow of a dual-chamber nutating pump may be effectively flattened using the third chamber and compensating piston disclosed here.

The third chamber and compensation piston may be placed in the output flow path of the first two chambers or of a dual-chamber nutating pump. The piston may be extended into and retracted from the third chamber during a pump cycle by a specially shaped cam, which may be driven by the pump motor. The cam and its engagement or coupling with the compensating piston are designed so that the compensating piston may be extended into the third chamber during output flow rate peaks and so that the compensating piston may be retracted from the third chamber during output flow rate valleys or lulls. When the compensating piston extends into the third chamber during an output flow rate peak, the compensating piston blocks some of the output flow from the first two chambers and some of the output flow is retained in the third chamber. Then, during a retraction of the compensation piston during an output flow valley, fluid retained fluid in the third chamber is released to increase the net output flow. Thus, the third chamber and compensating piston reduce the output flow during a peak and increase the output flow during a valley to provide a pump cycle that may be essentially linear and free of pulsations or peaks and valleys in the flow rate over the course of a pump cycle.

In another aspect, a nutating pump is disclosed, which comprises a nutating piston disposed in a pump housing. The pump housing comprises an inlet and an outlet. The pump housing further comprises a middle passage extending through the pump housing and intersecting the inlet and the outlet. The middle passage includes a middle section disposed between the inlet and the outlet and a distal section disposed opposite the inlet from the outlet and terminating at an enclosure. The nutating piston comprises a proximal section and a distal end with a pump section disposed therebetween. The pump section is at least partially and sealably accommodated in the middle section of the middle passage with the pump section extending at least partially across the inlet to the distal section of the middle passage. The proximal section of the nutating piston extends at least partially across the outlet. The pump section of the nutating piston comprises a recess that extends across at least part of the pump section to the distal end of the nutating piston. The proximal section of the nutating piston has a first maximum outer diameter and the pump section of the nutating piston has a second maximum outer diameter that is greater than the first maximum outer diameter. The proximal section is connected to the pump section at a transition section. The proximal section of the nutating piston is coupled to a drive shaft. The pump housing and the nutating piston define two pump chambers including a first pump chamber and a second pump chamber. The first pump chamber is defined by the distal end and the recess of the nutating piston and the distal section of the middle passage. The second pump chamber is defined by the transition section and a portion of the proximal section of the nutating piston that extends across the outlet of the pump housing and between the outer passage and the outlet. The outlet is in communication with a through passage of a compensating housing. The through passage extends past a compensating piston at a third pump chamber disposed in the through passage. The compensating piston is slidably and sealably accommodated in the compensating housing. The compensating piston includes a distal end directed towards the through passage and a proximal end engaging a bearing. The bearing engages a cam and the cam is coupled to the drive shaft. Wherein rotation of the drive shaft causes rotation of the cam, which imparts reciprocating movement to the bearing and the nutating piston thereby causing reciprocating movement of the distal end of the nutating piston into and out of the through passage.

In an embodiment, the middle passage of the pump housing extends at least substantially perpendicular to the inlet and the outlet and the outer passage of the pump housing extends at least substantially parallel to the middle passage.

In any one or more of the embodiments described above, the outlet of the pump housing is connected to an outlet housing disposed between the outlet and the compensating housing. The outlet housing has an outlet passage that is in communication with the through passage.

In any one or more of the embodiments described above, the compensating piston is slidably accommodated in a liner. The liner has a distal end facing the through passage of the compensating housing and a proximal end engaging a primary seal for inhibiting leakage between the compensating piston and the liner.

In any one or more of the embodiments described above, the primary seal is annular and has an outer periphery. The outer periphery comprises a slot for accommodating an O-ring. The O-ring is sandwiched between the outer periphery of the seal and a seal retainer. The seal retainer includes a proximal end with an opening through which the compensating piston passes. The proximal end is connected to a distal end by a continuous sidewall. The distal end of the seal retainer is biased against the compensating housing by a spring. The spring also biases the proximal end of the compensating piston against the bearing.

In any one or more of the embodiments described above, the cam, the compensating piston and the nutating piston are arranged so that when a cumulative output from the first and second pump chambers is at a maximum, a compensating output from the third pump chamber is at a minimum.

In any one or more of the embodiments described above, the cam, the compensating piston and the nutating piston are arranged so that when a cumulative output from the first and second pump chambers is at a minimum, a compensating output from the third pump chamber is at a maximum.

In any one or more of the embodiments described above, the drive shaft is coupled to a stepper motor.

In any one or more of the embodiments described above, the pump housing and the compensating housing are molded from a plastic material.

In another aspect, A method for providing a steady state output flow from a nutating pump that is operating at a constant motor speed is disclosed. The method comprises: providing a nutating pump with a first pump chamber, a second pump chamber, and a nutating piston, the first pump chamber producing a first output in response to a first 180° of rotation of the nutating piston, the second pump chamber producing a second output in response to a second 180° of rotation of the nutating piston, the nutating pump including an outlet; providing a compensating piston with a distal end that faces the outlet when the compensating piston is in a retracted position and that extends into the outlet when the compensating piston is in an extended position; extending the compensating piston into the outlet when a cumulative output from the first and second pump chambers approaches a maximum level; and retracting the compensating piston from the outlet when the cumulative output from the first and second pump chambers approaches a minimum level.

Other advantages and features will be apparent from the following detailed description when read in conjunction with the attached drawings.

BRIEF DESCRIPTION OF THE DRAWINGS

The disclosed embodiments are illustrated more or less diagrammatically in the accompanying drawings, wherein:

FIG. 10 is a side plan view of the compensating piston 110 of the nutating pump 120 shown in FIGS. 8-9;

FIG. 11 is a plan view of the sleeve 212 that accommodates the compensating piston 209 shown in FIGS. 9-10;

FIG. 12 is a perspective view of the O-ring retainer 221 that protects against leakage from the proximal end of the sleeve 212 shown in FIGS. 9 and 11;

FIG. 13 is a perspective view of the retainer seal 222 that surrounds the O-ring retainer 221, the sleeve 212 and part of the compensating piston 209 of the pump 120 as shown in FIG. 9;

FIG. 14 is another perspective view of the retainer seal 222 shown in FIG. 13;

FIG. 15 is a perspective view of the spring 223 that surrounds the retainer seal 222 shown in FIGS. 13-14;

FIG. 16 is a perspective view of the seal 214 through which the compensating piston 209 passes and that is sandwiched between the proximal end of the sleeve 212 and the proximal end of the retainer seal 222 as shown in FIG. 9;

FIG. 17 is a perspective view of the bearing assembly 234 that extends between the proximal end of the compensating piston 209 and the cam 201 of the pump 120;

FIG. 18 is a perspective view of the cam follower 226 through which the proximal end of the compensating piston 209 passes and which is partially received in the follower guide 228 illustrated in FIGS. 20-21;

FIG. 19 is another perspective view of the cam follower 226 shown in FIG. 18;

FIG. 20 is a perspective view of the follower guide 228, which receives the proximal portion 227 of the cam follower 226 illustrated in FIGS. 18-19;

FIG. 21 is another perspective view of the follower guide 228 illustrated in FIG. 20;

FIG. 22 is a perspective view of the cam 201, which is coupled to the drive shaft 125 as illustrated in FIG. 9 and which engages the bearing 234, which is illustrated in FIGS. 8 and 17;

FIG. 23 is another perspective view of the cam 201 illustrated in FIG. 22;

It will be noted that the drawings are not necessarily to scale and that the disclosed embodiments are sometimes illustrated by graphic symbols, phantom lines, diagrammatic representations and fragmentary views. In certain instances, details may have been omitted which are not necessary for an understanding of the disclosed embodiments or which render other details difficult to perceive. It should be understood, of course, that this disclosure is not limited to the particular embodiments illustrated herein.

DETAILED DESCRIPTION OF THE DISCLOSURE

Figure 1:
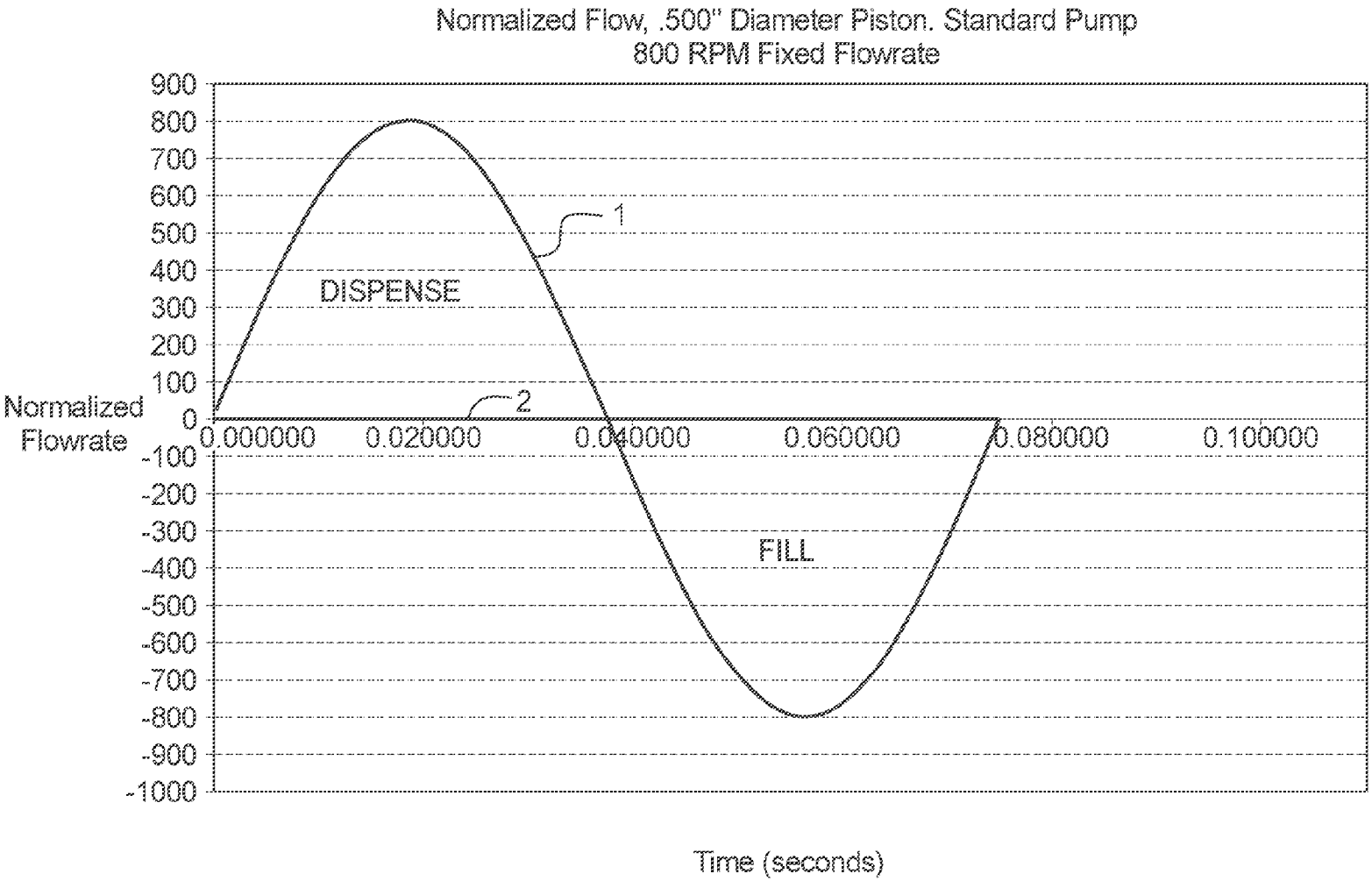
FIG. 1 (PRIOR ART)
FIG. 1 illustrates, graphically, a prior art dispense/fill profile for a prior art nutating pump operated at a fixed motor speed.
Figure 2:
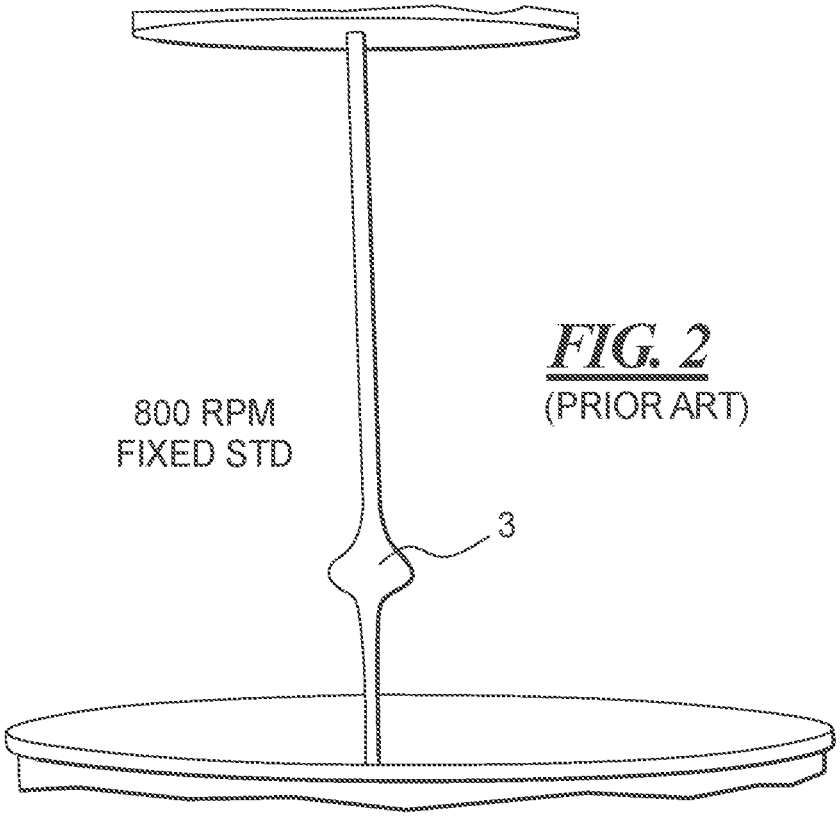
FIG. 2 (PRIOR ART)
FIG. 2 is a rendering from a photograph illustrating the pulsating dispense stream of the prior art nutating pump, the operation of which is graphically depicted in FIG. 1.
Figure 3:
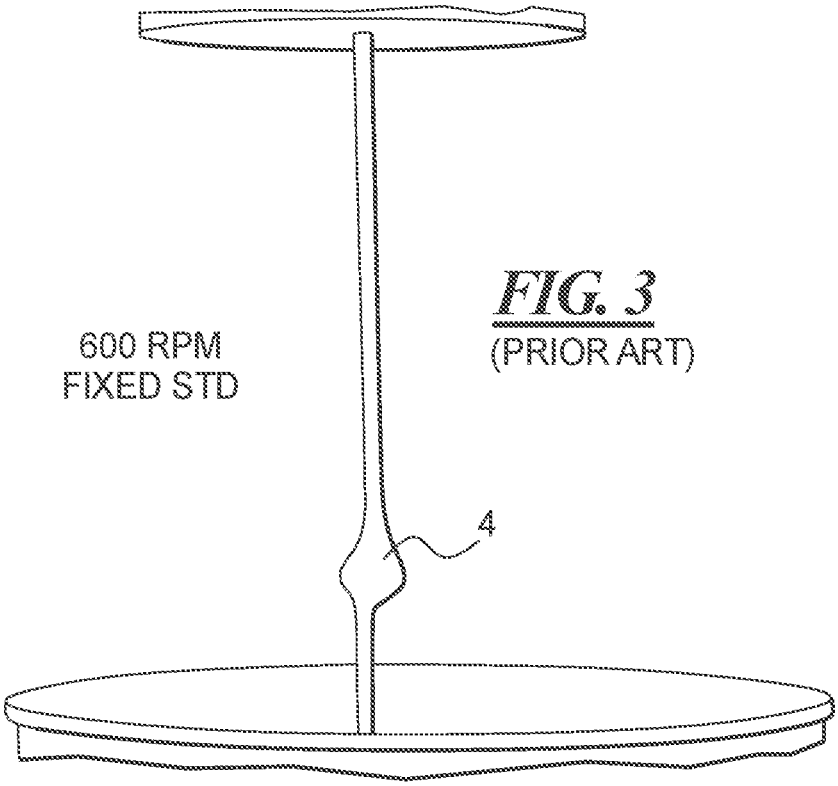
FIG. 3 (PRIOR ART)
FIG. 3 is another rendering of a photograph of an output stream of the prior art nutating pump of FIG. 1, operated at a constant, but slower motor speed than the motor speed of FIG. 2.
Figure 4:
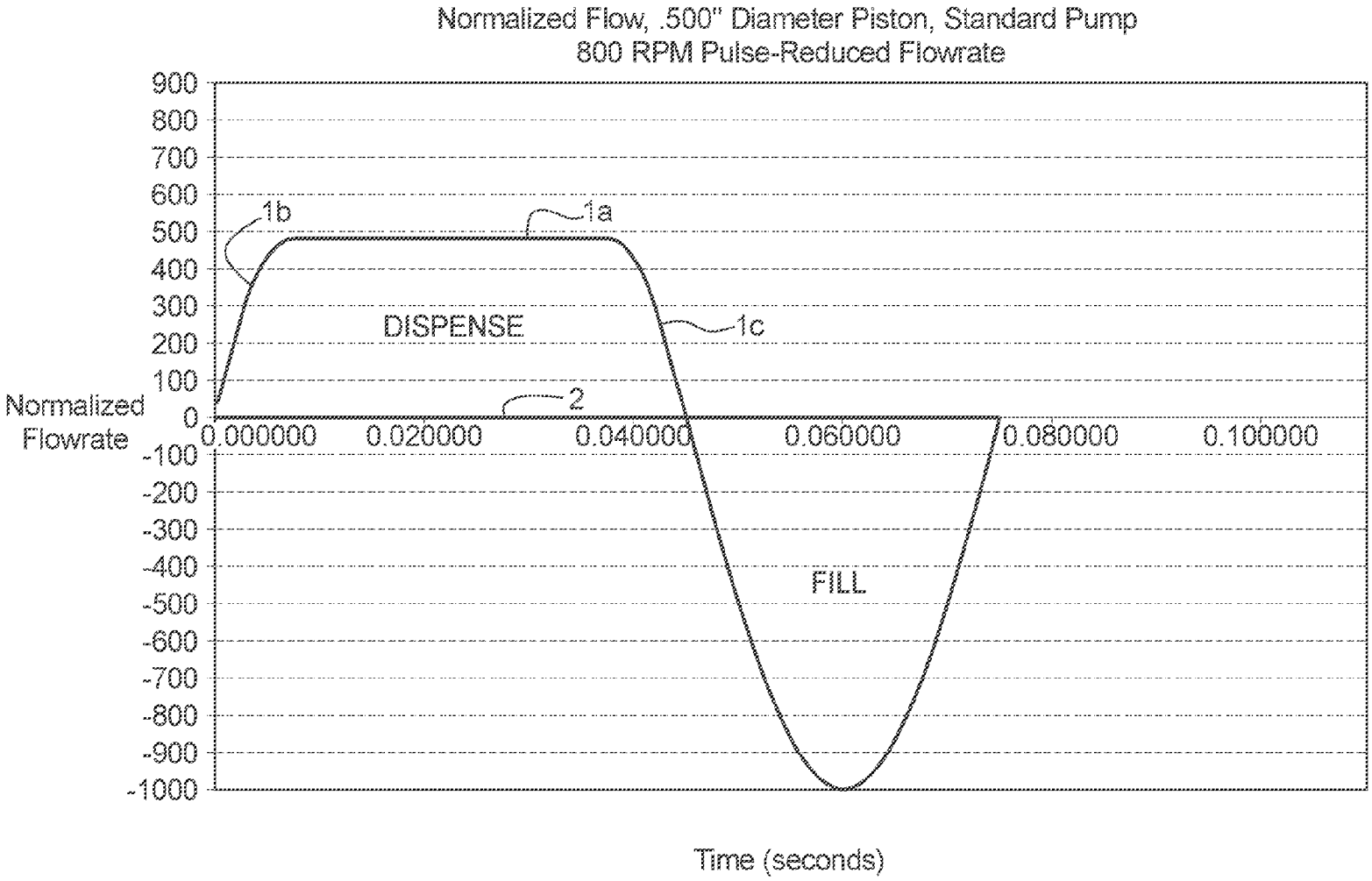
FIG. 4 (PRIOR ART)
FIG. 4 graphically illustrates a dispense and fill cycle for the prior art nutating pump of FIG. 1, when operated at variable speeds to reduce pulsing.
Figure 5:
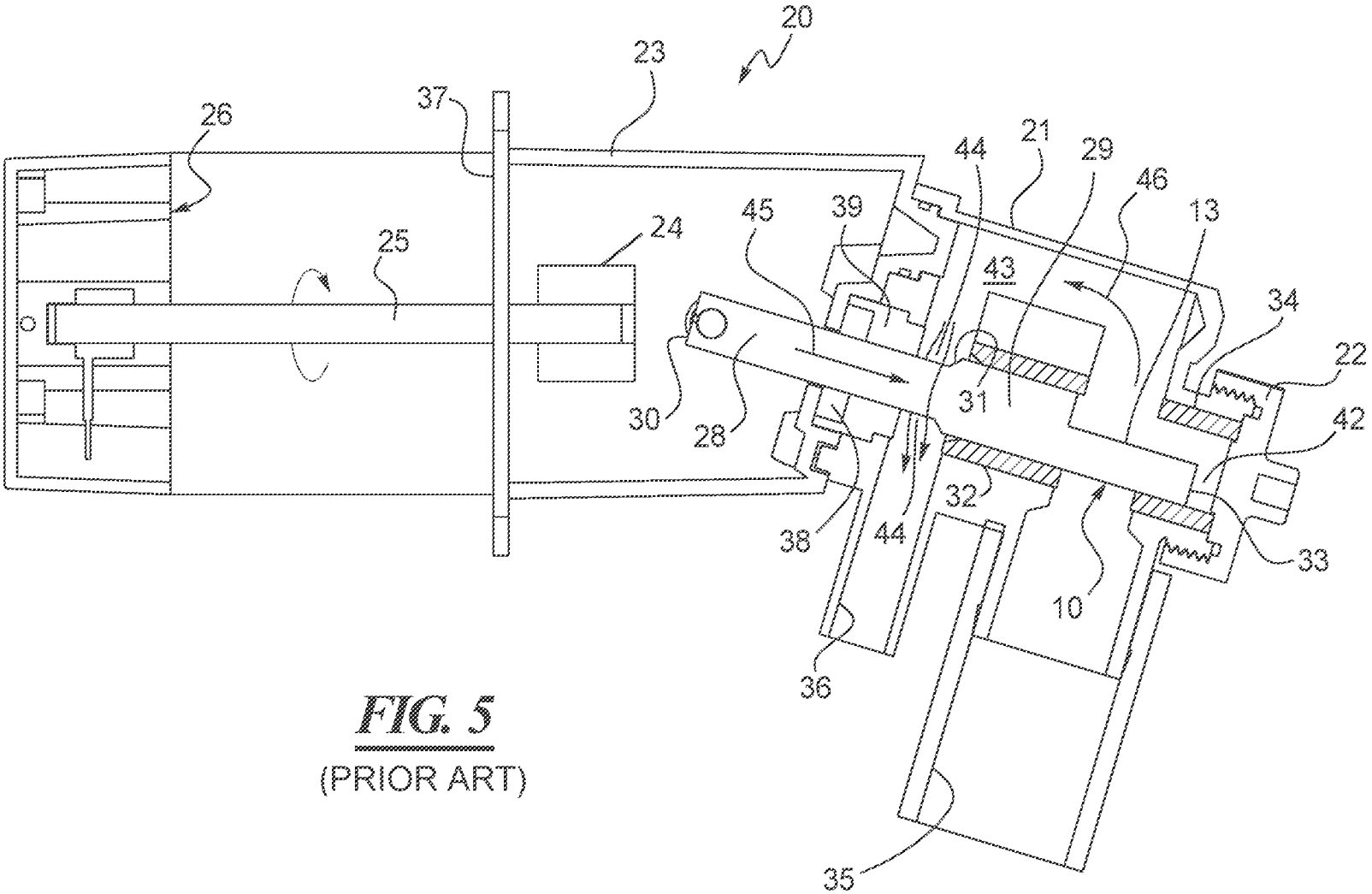
FIG. 5 (PRIOR ART)
FIG. 5 is a sectional view of a prior art dual-chamber nutating pump 20 showing the piston 10 at a mid-portion of its dispense stroke with the stepped transition 31 between the smaller proximal section 28 of the piston 10 and the larger pump section 29 of the piston 10 moving away from the "second" chamber 44 and with the distal end 33 of the piston 10 entering the first chamber 42.
Figure 6:
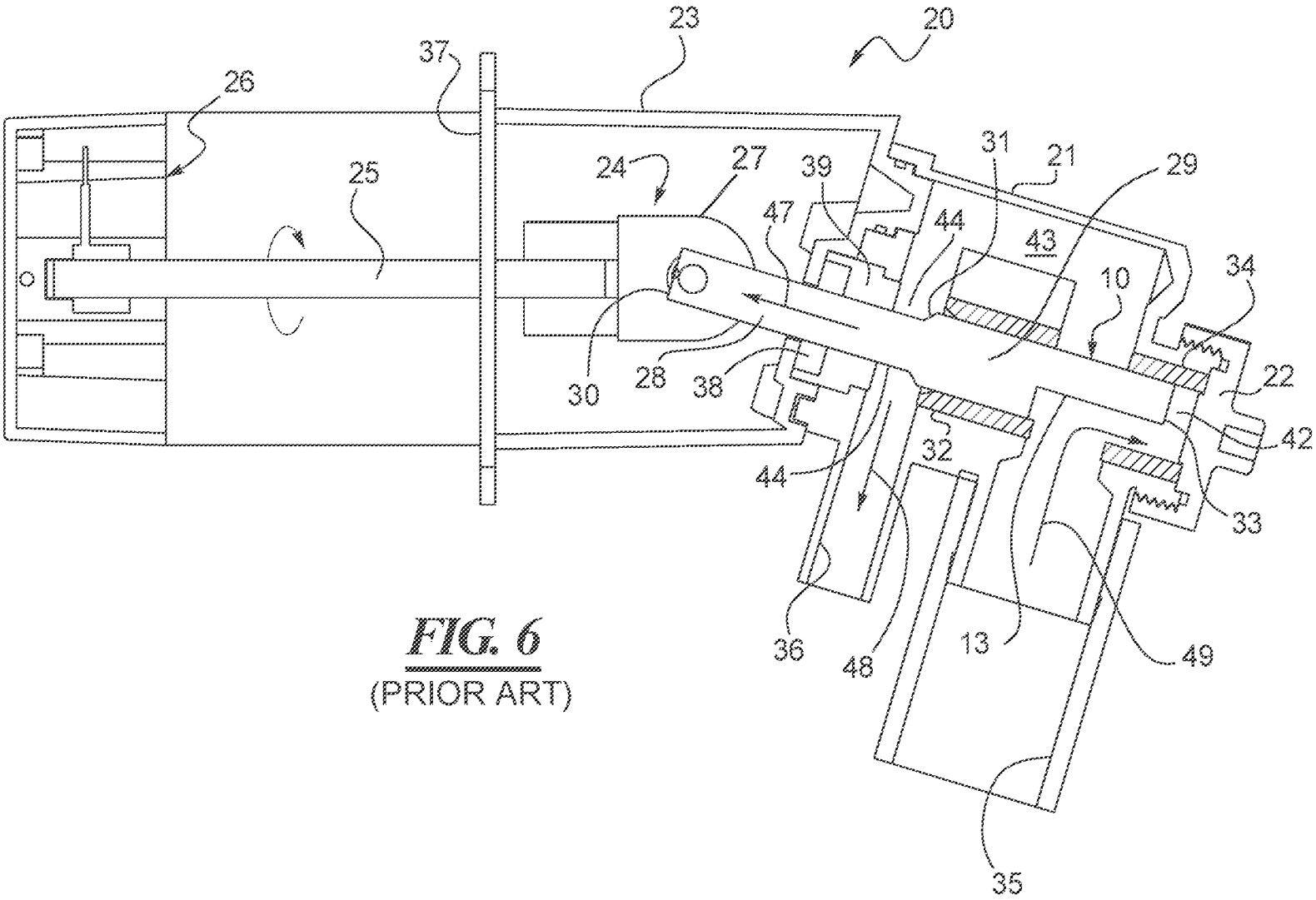
FIG. 6 (PRIOR ART)
FIG. 6 is another sectional view of the prior art dual-chamber nutating pump 20 illustrated in FIG. 5 but with the piston 10 rotated and moving away from the first chamber 42 and the housing enclosure 22 as the piston 10 moves to the middle of its down stroke, and further illustrating fluid entering the first chamber 42 and exiting the second chamber 44 as the stepped transition 31 enters the second chamber 44.
Figure 9:
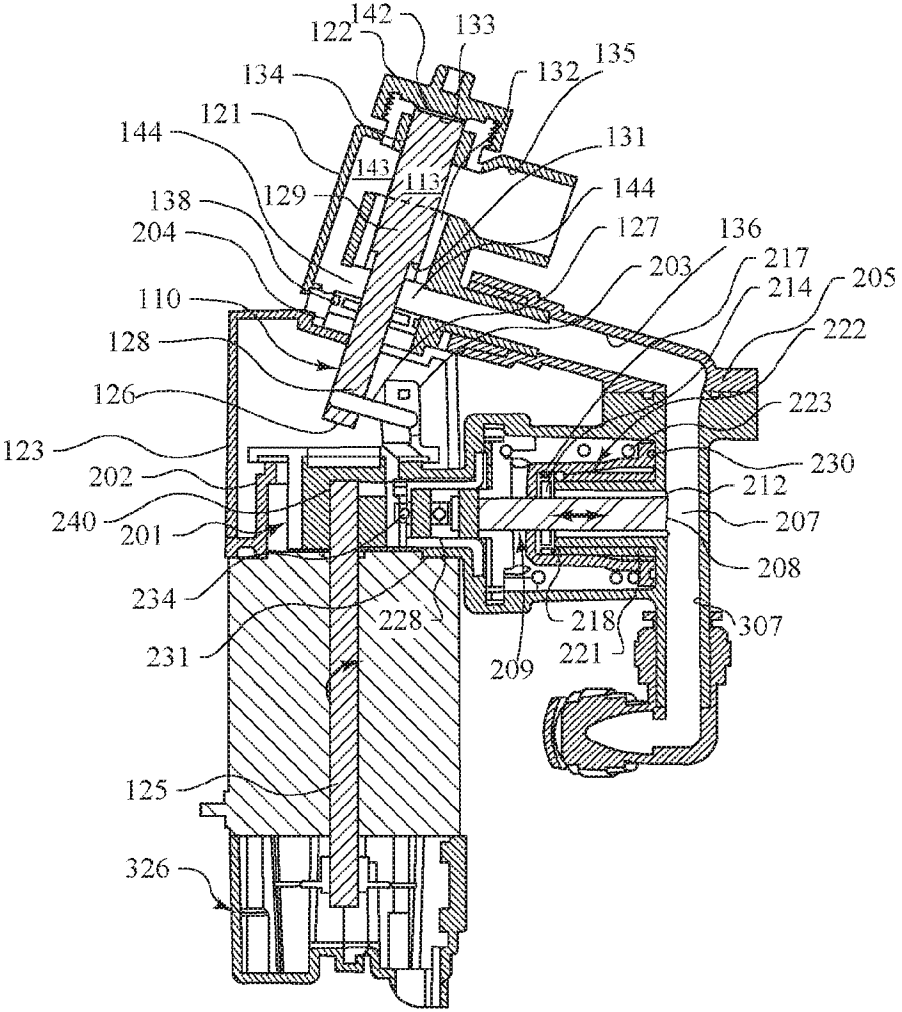
FIG. 9 is a sectional view of the tri-chamber nutating pump 120 of FIG. 8.
Figure 8:
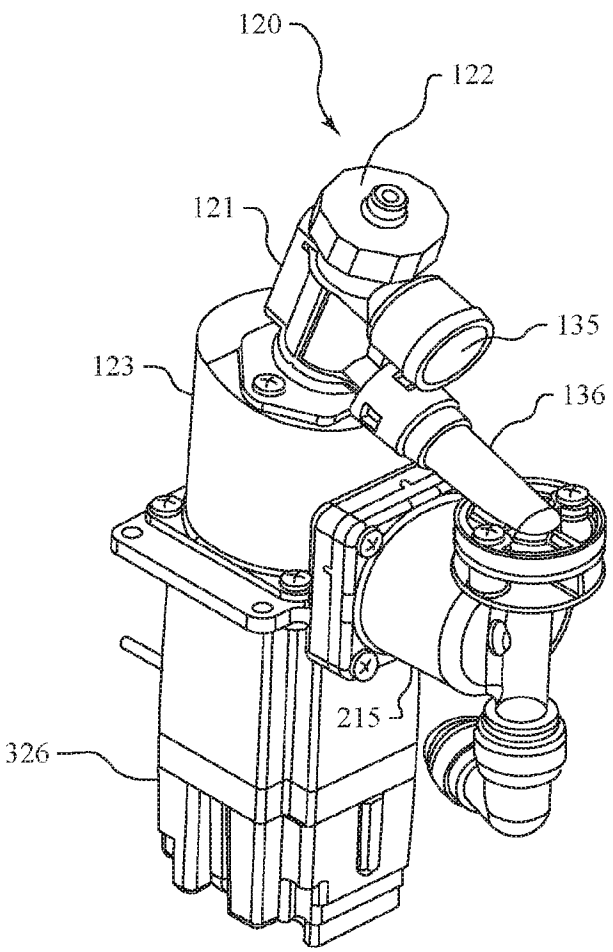
FIG. 8 is a perspective view of a disclosed tri-chamber nutating pump 120.

A nutating pump 120 is illustrated in FIGS. 8-9. The nutating pump 120 includes the basic features of the nutating pump as shown in FIGS. 5-6 and these features are identified using the reference numerals of FIGS. 5-6 with the prefix "1", e.g., the pump housing 121 as opposed to the pump housing "21". The nutating pump 120 includes a pump housing 121 that is coupled to an enclosure 122. The nutating pump 120 also includes an intermediate housing 123, which encloses the coupling 124, the proximal end 126 of the nutating piston 110 and the cam 201, which is also illustrated in FIGS. 22-23.

The intermediate housing 123 also encloses a shroud 202, which provides dust protection for the various mechanical components disposed in the intermediate housing 123. The shroud 202 is utilized because the nutating pump 120 may be used to dispense colorants. For example, tints or colorants used to add color the white base material of a paint mixture can generate dust if the solvent evaporates. This dust causes damage to mechanical components and must be cleaned, thereby leading to increased maintenance requirements.

The proximal end 126 of the nutating piston 110 is coupled to the upwardly extending tab 203 of the cam 201 by way of the link 127. Like the piston FIGS. 5-6, the nutating piston 110 also includes a proximal section 128 that has a smaller diameter than a distal pump section 129. The proximal section 128 passes through a bushing 204 as well as a seal 138. The proximal section 128 and the transition section 131 of the nutating piston 110 also pass through the second pump chamber 144. The pump section 129 is received in the middle seal 132 of the pump housing 121 and the distal end 133 of the nutating piston 110 is received in the distal seal 134. The first pump chamber 142 is barely visible in FIG. 9 as the distal end 133 of the nutating piston 110 is close to an abutting engagement with the enclosure 122. The position of the first pump chamber 142 is substantially the same as the first pump chamber "42" of FIGS. 5-6.

Thus, like the nutating pump shown in FIGS. 5-6, fluid enters the nutating pump 120 through the inlet 135 before being pushed into the first pump chamber 142 by the axial movement of the nutating piston 110 towards the enclosure 122 as well as the rotation of the nutating piston 110 and the engagement of fluid disposed in the first pump chamber 142 by a recess 113 in the pump section 129 of the nutating piston 110. The nutating pump 120 also includes an outer passage 143 that connects the first pump chamber 142 to the second pump chamber 144. The transition section 131, which is not beveled in the embodiment shown in FIG. 9, generates displacement through the second pump chamber 144 when the nutating piston 110 is retracted in a proximal direction away from the enclosure 122 as discussed above in connection with FIGS. 5-6. For the direction of flow, the reader is directed to FIGS. 5-6 and the explanation thereof.

The second pump chamber 144 is in communication with the outlet 136, which may be defined by an outlet housing 205 and the compensating housing 206. In the embodiment shown in FIG. 9, the compensating housing 206 may also partly define the third pump chamber 207 with the distal end 208 of the compensating piston 209 (see also FIG. 10), the distal end 312 of the liner 212 (see also FIG. 11), and the primary seal 214 (see also FIG. 16). The engagement between the proximal end 412 of the liner 212 and the primary seal 214 help to prevent leakage from the outlet 136 into the compensating housing 206. The primary seal 214 may include an outer periphery 314 with a peripheral slot 216 (FIG. 16) that may accommodate an additional O-ring 217 (FIG. 9). In addition, another O-ring 218 may be disposed between the primary seal 214 and an O-ring retainer 221 (see also FIG. 12). The O-ring retainer 221, O-ring 218, O-ring 217, and the primary seal 214 may all be accommodated within a seal retainer 222 (see also FIGS. 13-14). The seal retainer 221 includes a proximal end 322 with an opening 422 for accommodating the compensating piston 209. A continuous sidewall 522 connects the proximal end 322 to the distal flange 224. The seal retainer 222, in turn, may be accommodated within a spring 223 (see also FIG. 15) or other biasing element. The spring 223 may be trapped between the distal flange 224 (FIGS. 13-14) of the seal retainer 222 and the flange 225 of the cam follower 226 (see also FIGS. 18-19). The distal flange 224 may also include a slot 220 (FIG. 13) for accommodating the O-ring 230 (FIG. 9).

The cam follower 226 may be prevented from rotation by passing the proximal forked end 227 of the cam follower 226 through the follower guide 228, which is shown in FIGS. 20-21 as well as FIG. 9. The follower guide 228 includes a rectangular proximal section 229, which is received in a similarly configured rectangular opening 231 in the compensating housing 206, which in turn, prevents rotation of the cam follower 226 and rotation of the compensating piston 209. The proximal forked end 227 of the cam follower 226 may pass through the rectangular proximal section 229 of the follower guide 228 before it is linked to the proximal end 232 of the compensating piston 209 (see also FIG. 10) by passing a pin (not shown) through the openings 233 in the proximal forked end of 227 of the cam follower 226 (FIGS. 18-19) and the opening 332 in the proximal end 232 of the compensating piston 209. The proximal forked end 227 of the cam follower 226 also engages the bearing 234 (see also FIG. 17) or a roller, which in turn engages the cam 201 or, more specifically, the proximal section 235 of the cam 201 (see FIGS. 22-23). The proximal section 235 is coupled for rotation with the drive shaft 125 by way of a pin, set screw or other type of connection that will be apparent to those skilled in the art. As shown in FIG. 9, the proximal section 235 of the cam 201 is hollow for receiving the distal end 240 of the drive shaft 125.

Figure 24:
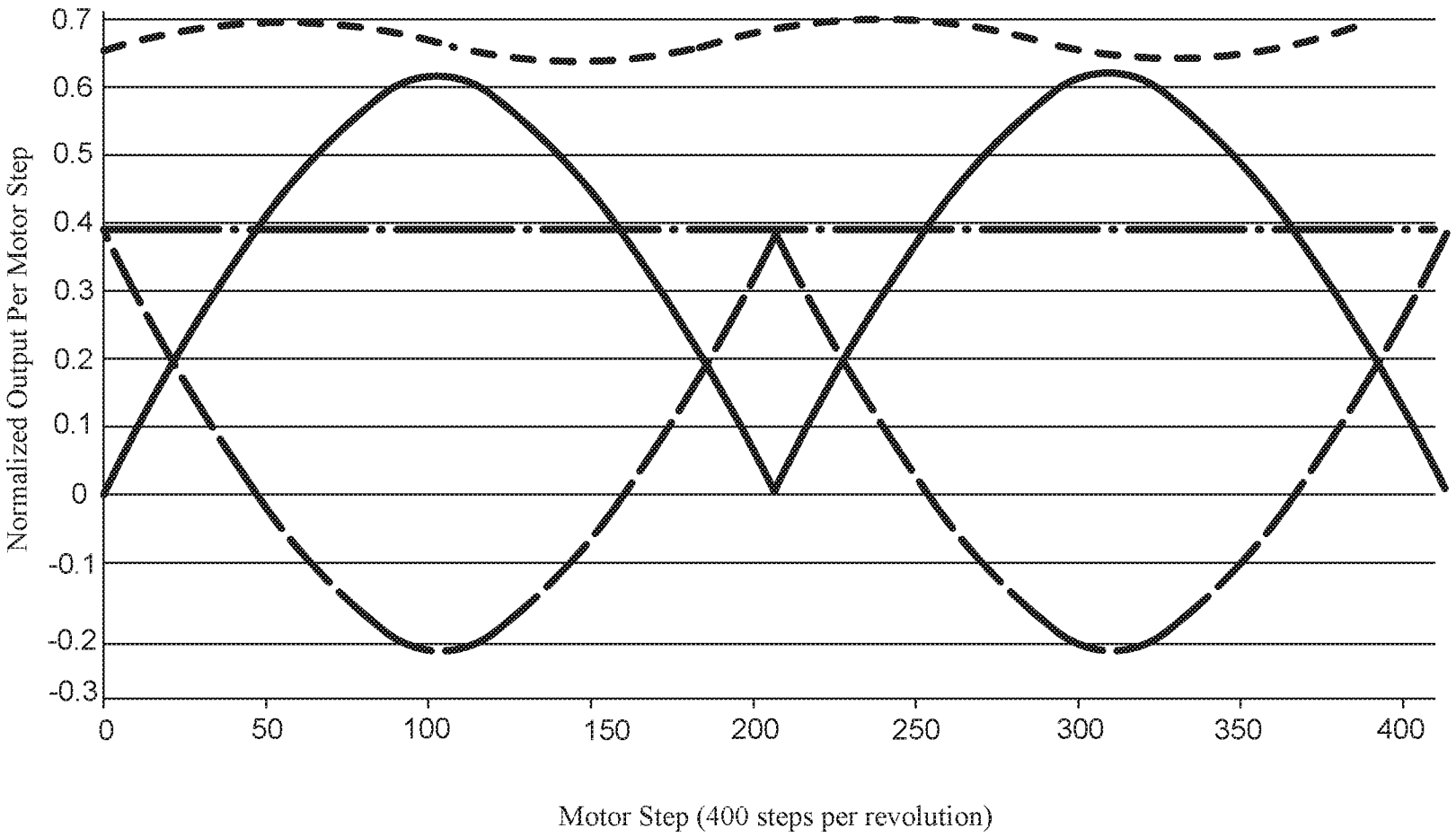
FIG. 24 illustrates, graphically, the non-pulsating flow of the tri-chamber nutating pump 120 disclosed herein.

FIG. 24 graphically illustrates the output flow per individual step of the stepper motor 326 where each 360° of rotation of the drive shaft 125 equals 400 individual steps of the stepper motor 326. The linearized shape of the proximal section 235 of the cam 201 is illustrated by the line 301. The output from the third pump chamber 207 is illustrated by the line 302. Further, the normalized output of the first and second pump chambers 142, 144 is illustrated by the line 303. Finally, the normalized output or combined tri-chamber output is illustrated by the line 304. Starting from the left side of FIG. 24, the output from the first and second pump chambers 142, 144 as represented by the line 303 begins at zero and begins to approach its maximum output at about 100 motor steps, which has a normalized output value of about 0.6. Contemporaneously, because the compensating piston 209 has not been pushed out into the outlet 136 or through passage 307, the output through the third pump chamber 207 begins at its maximum normalized value of about 0.4 and initially declines to its lowest value of less than −0.2 at about 100 motor steps. Thus, the output of the first and second pump chambers 142, 144 is at its maximum at 100 motor steps when the output through the third pump chamber 207 has reached a negative value. Thus, the combined output from the nutating pump 120 as represented by the line 304 remains steady at slightly less than about 0.4. This pattern continues throughout the rest of the dispense profile. Whenever the output from the first and second pump chambers 142, 144 reaches its maximum, the compensating piston 209 has been pushed into the outlet 136 to thereby impede the output from the first and second pump chambers 142, 144.

Then, as the compensating piston 209 is retracted back towards the position shown in FIG. 9, the output from the third pump chamber 207 increases towards its maximum normalized output of close to 0.4 at 200 steps. Contemporaneously, the output from the first and second pump chambers 142, 144 decreases from its maximum after step 100 and the cumulative output from all three pump chambers 142, 144, 207 is maintained at the steady normalized value of about 0.4 (line 304). At about motor step 200, the output through the third pump chamber 207 is at its maximum and the output from the first and second pump chambers 142, 144 reaches about 0. This pattern is repeated for the second dispense portion of the profile (motor steps 200-400), which is identical to the first dispense portion of the profile (motor steps 0-200). After motor step 200, the nutating pump 120 also begins the fill portion of its profile, which is not shown in FIG. 24 (see the line number **1*f* of FIG. 7**).

INDUSTRIAL APPLICABILITY

The disclosed tri-chamber nutating pump 120 is useful for dispensing liquids, especially viscous liquids, with precision, accuracy and speed. The nutating pump 120 is particularly useful for dispensing paints and cosmetics and is especially useful for dispensing tints or colorants into a receptacle that may already include a liquid such as a base material for a paint or cosmetics product. Specifically most paints include a white base material, which is colored by adding concentrated tints or colorants to the base material. These tints or colorants must be accurately dispensed so that each can of paint has the same color. Any splashing of the tint dispensed onto the base in the paint receptacle will cause inaccuracies in the dispense and compromise the quality of the final product. Further, any splashing of tints or colorants must be cleaned up by maintenance personnel which is time consuming and costly. In addition to paint and cosmetics dispensing, the nutating pump 120 is useful for any application where the dispensing of viscous liquid materials is required with precision, accuracy and speed.

Figure 7:
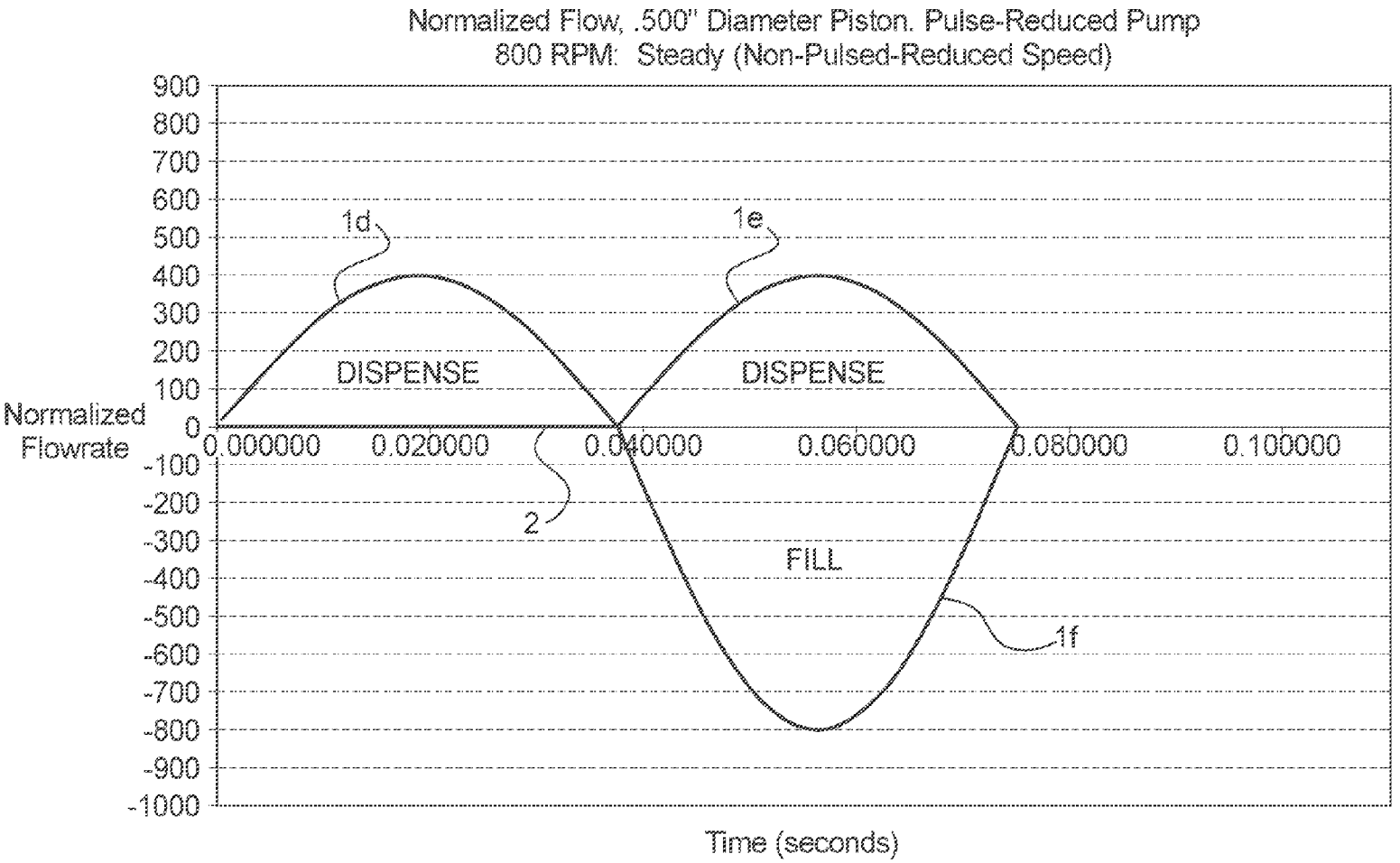
FIG. 7 (PRIOR ART)
FIG. 7 graphically illustrates the dispense profile for the prior art dual-chamber nutating pump 20 of FIGS. 5-6 operating at a constant motor speed of 800 rpm to provide two modified dispense profiles 1*d*, 1*e*, the first of which occurs during the dispense portion of the cycle and the second of which occurs during the fill portion of the cycle.

The tri-chamber nutating pump 120 represents a substantial improvement over the nutating pump 120 illustrated in FIGS. 5-7 above. Specifically, the normalized combined output from the first, second and third pump chambers 142, 144, 207 remains steady through a complete 360° rotation of the drive shaft 125.

While only certain embodiments have been set forth, alternative embodiments and various modifications will be apparent from the above description to those skilled in the art. These and other alternatives are considered to fall within the spirit and scope of this disclosure.

The invention claimed is:

1. A nutating pump, comprising:

a nutating piston disposed in a pump housing, the pump housing comprising an inlet and an outlet, the pump housing further comprising a middle passage extending through the pump housing and intersecting the inlet and the outlet, the middle passage including a middle section disposed between the inlet and the outlet and a distal section disposed opposite the inlet from the outlet and terminating at an enclosure, the nutating piston comprising a proximal section and a distal end with a pump section disposed therebetween, the pump section at least partially and slidably accommodated in the middle section of the middle passage with the pump section extending at least partially across the inlet to the distal section of the middle passage, the proximal section of the nutating piston extending at least partially across the outlet, the pump section of the nutating piston comprising a recess extending across at least part of the pump section to the distal end of the nutating piston, the proximal section of the nutating piston having a first maximum outer diameter, the pump section of the nutating piston having a second maximum outer diameter that is greater than the first maximum outer diameter, the proximal section connected to the pump section at a transition section, the proximal section of the nutating piston coupled to a drive shaft, the pump housing and the nutating piston defining two pump chambers including a first pump chamber and a second pump chamber, the first pump chamber defined by the distal end and the recess of the nutating piston and the distal section of the middle passage, the second pump chamber defined by the transition section and a portion of the proximal section of the nutating piston that extends across the outlet of the pump housing and between the outer passage and the outlet, the outlet in communication with a through passage of a compensating housing, the through passage extending past a compensating piston at a third pump chamber disposed in the through passage, the compensating piston being slidably and sealably accommodated in the compensating housing, the compensating piston including a distal end directed towards the through passage and a proximal end engaging a bearing, the bearing engaging a cam, the cam coupled to the drive shaft, wherein rotation of the drive shaft causing rotation of the cam, which imparts reciprocating movement to the bearing and the nutating piston thereby causing reciprocating movement of the distal end of the nutating piston into and out of the through passage.

2. The nutating pump of claim 1 wherein the middle passage of the pump housing extends at least substantially perpendicular to the inlet and the outlet and the outer passage of the pump housing extends at least substantially parallel to the middle passage.

3. The nutating pump of claim 1 wherein the outlet of the pump housing is connected to an outlet housing disposed between the outlet and the compensating housing, the outlet housing having an outlet passage providing communication between the outlet and the through passage.

4. The nutating pump of claim 1 wherein the compensating piston is slidably accommodated in a liner, the liner having a distal end facing the through passage of the compensating housing and a proximal end engaging a primary seal for inhibiting leakage between the compensating piston and the liner.

5. The nutating pump of claim 4 wherein the primary seal is annular and has an outer periphery, the outer periphery comprising a slot for accommodating an O-ring, the O-ring sandwiched between the outer periphery of the seal and a seal retainer, the seal retainer including a proximal end with an opening through which the compensating piston passes, the proximal end connected to a distal end by a continuous sidewall, the distal end of the seal retainer being biased against the compensating housing by a spring, the spring also biasing the proximal end of the compensating piston against the bearing.

6. The nutating pump of claim 1 wherein the cam, the compensating piston and the nutating piston are arranged so that when a cumulative output from the first and second pump chambers is at a maximum, a compensating output from the third pump chamber is at a minimum.

7. The nutating pump of claim 1 wherein the cam, the compensating piston and the nutating piston are arranged so that when a cumulative output from the first and second pump chambers is at a minimum, a compensating output from the third pump chamber is at a maximum.

8. The nutating pump of claim 1 wherein the drive shaft is coupled to a stepper motor.

9. The nutating pump of claim 1 wherein the pump housing and the compensating housing are molded from a plastic material.

10. A method for providing a steady state output flow from a nutating pump that is operating at a constant motor speed, the method comprising:

providing a nutating pump with a first pump chamber, a second pump chamber, and a nutating piston, the first pump chamber producing a first output in response to a first 180° of rotation of the nutating piston, the second pump chamber producing a second output in response to a second 180° of rotation of the nutating piston, the nutating pump including an outlet, providing a compensating piston with a distal end that faces the outlet when the compensating piston is in a retracted position and that extends into the outlet when the compensating piston is in an extended position, extending the compensating piston into the outlet when a cumulative output from the first and second pump chambers approaches a maximum level, and retracting the compensating piston from the outlet when the cumulative output from the first and second pump chambers approaches a minimum level.

* * * * *